US010766590B2

(12) United States Patent
Nanjo et al.

(10) Patent No.: US 10,766,590 B2
(45) Date of Patent: Sep. 8, 2020

(54) OUTBOARD MOTOR

(71) Applicants: YAMAHA HATSUDOKI KABUSHIKI KAISHA, Iwata-shi, Shizuoka (JP); MARINE CANADA ACQUISITION INC., Richmond (CA)

(72) Inventors: Morihiko Nanjo, Shizuoka (JP); Noam Dean Davidson, Richmond (CA); Richard Tyler Redfern, Richmond (CA); Mark Isaac Dyck, Richmond (CA); Eric B. Fetchko, Richmond (CA)

(73) Assignees: YAMAHA HATSUDOKI KABUSHIKI KAISHA, Shizuoka (JP); MARINE CANADA ACQUISITION INC., Richmond (CA)

( * ) Notice: Subject to any disclaimer, the term of this patent is extended or adjusted under 35 U.S.C. 154(b) by 0 days.

(21) Appl. No.: 16/409,954

(22) Filed: May 13, 2019

(65) Prior Publication Data

US 2019/0344872 A1 Nov. 14, 2019

(30) Foreign Application Priority Data

May 14, 2018 (JP) ..... 2018-092953

(51) Int. Cl.
*B63H 20/12* (2006.01)
*B63H 20/06* (2006.01)

(52) U.S. Cl.
CPC ..... *B63H 20/12* (2013.01); *B63H 20/06* (2013.01)

(58) Field of Classification Search
CPC ..... B63H 20/12; B63H 20/06; B63H 21/26; B63H 21/265; B63H 21/28
See application file for complete search history.

(56) References Cited

U.S. PATENT DOCUMENTS

| | | | | |
|---|---|---|---|---|
| 2,683,379 | A | 7/1954 | Strandgren | |
| 7,150,664 | B1 | 12/2006 | Uppgard et al. | |
| 7,311,571 | B1 | 12/2007 | Swan et al. | |
| 9,045,212 | B2 * | 6/2015 | Kadobayashi | B63H 20/12 |
| 9,139,275 | B2 * | 9/2015 | Kimura | B63H 20/10 |
| 2007/0066156 | A1 | 3/2007 | Mizutani | |
| 2012/0286129 | A1 * | 11/2012 | Daikoku | B63H 21/20 248/642 |

FOREIGN PATENT DOCUMENTS

| | | | |
|---|---|---|---|
| JP | 59-45295 | A | 3/1984 |
| JP | 6859353 | B2 | 2/2016 |

* cited by examiner

*Primary Examiner* — Anthony D Wiest

(74) *Attorney, Agent, or Firm* — Keating and Bennett, LLP

(57) ABSTRACT

An outboard motor includes a steering arm that turns around a centerline of a steering shaft together with the steering shaft, a steering actuator including a movable body that moves in a right-left direction, and a motion converter that converts a movement of the movable body in the right-left direction into a turning motion of the steering arm around the centerline of the steering shaft. The motion converter includes a bushing holder into which the steering arm is inserted in a front-rear direction and a bushing interposed between the steering arm and the bushing holder and including an outer surface provided with a pair of first sliding portions each including a convex arc-shaped vertical section that is perpendicular or substantially perpendicular to the right-left direction.

21 Claims, 8 Drawing Sheets

OUTBOARD MOTOR

CROSS REFERENCE TO RELATED APPLICATIONS

This application claims the benefit of priority to Japanese Patent Application No. 2018-092953 filed on May 14, 2018. The entire contents of this application are hereby incorporated herein by reference.

BACKGROUND OF THE INVENTION

1. Field of the Invention

The present invention relates to an outboard motor that propels a vessel.

2. Description of the Related Art

U.S. Pat. No. 7,311,571 B1 discloses a vessel propulsion apparatus that includes an outboard motor. The vessel propulsion apparatus includes a transom bracket that is to be attached to a transom, a swivel bracket that is supported by the transom bracket rotatably around a tilt axis, and a steering cylinder that turns the outboard motor around a steering axis relative to the swivel bracket. The front end portion of a cowl of the outboard motor is disposed above the transom bracket. The steering cylinder is disposed between the transom bracket and the cowl of the outboard motor.

The steering cylinder houses a piston member that moves in a right-left direction. The piston member includes a pivot support structure that supports a pivot member into which a steering arm is inserted, and two end portions that are disposed on the respective right and left of the pivot support structure. The pivot member has a cylindrical shape extending in an up-down direction and is turnable around the centerline of the pivot member relative to the pivot support structure. The steering arm has a cylindrical shape extending in a front-rear direction and is inserted into a through-hole that penetrates the pivot member in the front-rear direction.

When the steering cylinder moves the piston member in the right-left direction, the pivot member is pushed by the pivot support structure in the right-left direction, and the steering arm turns around the steering axis while the pivot member turns around the centerline of the pivot member. This allows the outboard motor to turn around the steering axis together with the steering arm, and the vessel to be steered.

When the outboard motor generates high thrust, the outboard motor may slightly tilt forward or rearward relative to the swivel bracket. In this case, a force to move the front end of the steering arm upward or downward in a diagonally rearward direction is generated. The force is transmitted from the steering arm to the pivot member, and presses a portion of the pivot member against the pivot support structure at high pressure. When the piston member moves in the right-left direction under this condition, high frictional force is generated between the pivot member and the pivot support structure, thus decreasing the transmission efficiency of the power transmitted from the steering cylinder to the outboard motor.

SUMMARY OF THE INVENTION

In order to overcome the previously unrecognized and unsolved challenges described above, preferred embodiments of the present invention provide outboard motors that each prevent a reduction in the transmission efficiency of the power to steer an outboard motor main body. A preferred embodiment of the present invention provides an outboard motor including a steering shaft extending in an up-down direction, an outboard motor main body that rotates around a centerline of the steering shaft together with the steering shaft and that includes a prime mover that generates power to rotate a propeller, a steering arm that extends forward from the steering shaft and that turns around the centerline of the steering shaft together with the steering shaft, a steering actuator including a movable body that moves in a right-left direction, and a motion converter that converts a movement of the movable body in the right-left direction into a turning motion of the steering arm around the centerline of the steering shaft, and that includes a bushing holder into which the steering arm is inserted in a front-rear direction and a bushing interposed between the steering arm and the bushing holder and including an outer surface provided with a pair of first sliding portions each including a convex arc-shaped vertical section that is perpendicular or substantially perpendicular to the right-left direction.

With the above structural arrangement, when the steering actuator moves the movable body in the right-left direction, the motion in the right-left direction is converted into a turning motion of the steering arm by the motion converter. The turning motion of the steering arm is transmitted to the outboard motor main body through the steering shaft. This causes the outboard motor main body to turn around the centerline of the steering shaft, thus allowing the outboard motor main body to be steered.

The steering arm extends forward from the steering shaft and is inserted into the bushing holder in the front-rear direction. The bushing is interposed between the steering arm and the bushing holder. The bushing includes an outer surface that includes a pair of first sliding portions. The bushing is retained in the bushing holder through at least the pair of first sliding portions. The first sliding portions have a convex arc-shaped vertical section that is perpendicular or substantially perpendicular to the right-left direction. That is, the vertical section of the first sliding portions defines an arc shape.

When the prime mover of the outboard motor main body rotates the propeller, a thrust to propel the hull forward or rearward is generated. When a force moves the front end of the steering arm upward or downward in a diagonally rearward direction in accordance with the generation of the thrust, the bushing turns relative to the bushing holder around a turning axis that passes through the bushing and that extends in the right-left direction while the pair of first sliding portions of the outer surface of the bushing slide on the bushing holder. This weakens a force that presses the bushing against the bushing holder.

As described above, when the force that moves the front end of the steering arm upward or downward in a diagonally rearward direction is generated, the steering arm and the bushing are intentionally moved relative to the bushing holder. Thus, it is possible to prevent the bushing from being pressed against the bushing holder at high pressure and to efficiently transmit the power of the steering actuator to the outboard motor main body.

The prime mover may be an engine (internal combustion engine) or an electric motor, or may be both an engine and an electric motor. The steering actuator converts energy such as electric power or hydraulic pressure into a linear motion of the movable body in the right-left direction. The steering actuator may be an electric actuator or a hydraulic actuator, or an actuator other than these. The first sliding portions provided on the outer surface of the bushing may have a spherical cap shape or a strip shape having an arc-shaped cross section. That is, the first sliding portions define a portion of a spherical surface or a portion of a cylindrical surface.

In preferred embodiments of the present invention, at least one of the following features may be added to the outboard motor.

The outer surface of the bushing includes the pair of first sliding portions each including the convex arc-shaped vertical section that is perpendicular or substantially perpendicular to the right-left direction and a pair of second sliding portions each including a convex arc-shaped horizontal section that is perpendicular or substantially perpendicular to the up-down direction.

With the above structural arrangement, not only the first sliding portions having a convex arc-shaped vertical section but also the second sliding portions having a convex arc-shaped horizontal section are provided on the outer surface of the bushing. While the movable body of the steering actuator moves in the right-left direction, the steering arm turns around the centerline of the steering shaft extending in the up-down direction. Since the movement directions of the movable body and the steering arm are different from each other, moving the movable body in the right-left direction will generate a force to turn the bushing around a vertical axis that passes through the bushing.

The force causes the bushing to turn relative to the bushing holder around the vertical axis while the pair of second sliding portions of the outer surface of the bushing slide on the bushing holder. This prevents the bushing from being pressed against the bushing holder at high pressure. Furthermore, since the first sliding portions and the second sliding portions are provided on the bushing, the outboard motor is reduced in size compared with a case in which the first sliding portions and the second sliding portions are provided on respective separate members.

Another preferred embodiment of the present invention provides an outboard motor including a steering shaft extending in an up-down direction, an outboard motor main body that rotates around a centerline of the steering shaft together with the steering shaft and that includes a prime mover that generates power to rotate a propeller, a steering arm that extends forward from the steering shaft and that turns around the centerline of the steering shaft together with the steering shaft, a steering actuator including a movable body that moves in a right-left direction, and a motion converter that converts a movement of the movable body in the right-left direction into a turning motion of the steering arm around the centerline of the steering shaft, and that includes a bushing holder into which the steering arm is inserted in a front-rear direction and a bushing interposed between the steering arm and the bushing holder and including an outer surface provided with a pair of sliding portions each having a spherical cap-shape.

With the above structural arrangement, the steering arm extends forward from the steering shaft and is inserted into the bushing holder in the front-rear direction. The bushing is interposed between the steering arm and the bushing holder. The outer surface of the bushing includes a pair of sliding portions. The bushing is retained in the bushing holder through at least the pair of sliding portions. The sliding portions define a rotating body that is obtained by rotating an arc around a straight line that passes through the midpoint of the arc and the center of the arc.

When the prime mover of the outboard motor main body rotates the propeller, a thrust to propel the hull forward or rearward is generated. When a force moves the front end of the steering arm upward or downward in a diagonally rearward direction in accordance with the generation of the thrust, the bushing turns relative to the bushing holder around the turning axis that passes through the bushing and that extends in the right-left direction while the pair of sliding portions of the outer surface of the bushing slide on the bushing holder.

Furthermore, while the movable body of the steering actuator moves in the right-left direction, the steering arm turns around the centerline of the steering shaft extending in the up-down direction. Thus, moving the movable body in the right-left direction generates a force to turn the bushing around the vertical axis that passes through the bushing. At this time, the bushing turns relative to the bushing holder around the vertical axis while the pair of sliding portions of the outer surface of the bushing slide on the bushing holder.

As described above, when a force moves the front end of the steering arm upward or downward in a diagonally rearward direction in accordance with the generation of the thrust, the bushing turns relative to the bushing holder. Likewise, when the steering actuator moves the movable body in the right-left direction, the bushing turns relative to the bushing holder. That is, regardless of the direction of the torque applied to the bushing, the bushing turns relative to the bushing holder and the torque is released. This prevents the bushing from being pressed against the bushing holder at high pressure, thus allowing the power of the steering actuator to be efficiently transmitted to the outboard motor main body.

In the above preferred embodiments, at least one of the following features may be added to the outboard motors.

The outboard motor main body is turnable around the centerline of the steering shaft between a right maximum steered position in which the outboard motor main body is steered to a rightmost position and a left maximum steered position in which the outboard motor main body is steered to a leftmost position, and a front end of the steering arm extends at least beyond a midpoint of the bushing when the outboard motor main body is at either of the right maximum steered position and the left maximum steered position. The front end of the steering arm may be located in front of the bushing when the outboard motor main body is at either of the right maximum steered position and the left maximum steered position.

With the above structural arrangement, when the outboard motor main body is steered, the bushing moves along the steering arm in a direction perpendicular or substantially perpendicular to the centerline of the steering shaft. When the outboard motor main body is located at the right maximum steered position or the left maximum steered position, the bushing is the farthest from the centerline of the steering shaft, so that the distance from the centerline of the steering shaft to the bushing is the longest. As the outboard motor main body approaches an original position at the midpoint between the right maximum steered position and the left maximum steered position, the bushing approaches the centerline of the steering shaft.

The front end of the steering arm is located in front of the bushing when the outboard motor main body is located at either of the right maximum steered position and the left maximum steered position. Thus, when the outboard motor main body is located at any position within the range from the right maximum steered position to the left maximum steered position, the steering arm projects forward from the bushing, and the front end of the steering arm is located in front of the bushing.

In the case in which the front end of the steering arm is located inside the bushing, when the outboard motor main body is steered, the bushing moves along the steering arm, and the length of a portion of the steering arm in contact with the bushing varies. Thus, locating the front end of the steering arm in front of the bushing at all times makes it possible to stabilize the contact area between the steering arm and the bushing and minimize variations in pressure caused between the steering arm and the bushing.

The bushing holder includes an inner circumferential surface defining an arm-insertion hole into which the steering arm is inserted, and a length of the arm-insertion hole in the right-left direction increases at a rear end of the arm-insertion hole.

With the above structural arrangement, the steering arm is inserted into the arm-insertion hole of the bushing holder. When the steering actuator moves the movable body in the right-left direction, the angle of the steering arm with respect to the arm-insertion hole changes. The width of the arm-insertion hole, that is, the length of the arm-insertion hole in the right-left direction increases at the rear end of the arm-insertion hole. Thus, when the movable body moves in the right-left direction, it is possible to prevent the steering arm from coming into contact with the bushing holder.

The steering actuator further includes a support shaft that penetrates the movable body in the right-left direction, and the movable body includes a bearing surrounding the support shaft and a housing surrounding the bearing, and the bearing includes an outer race that rotates around a centerline of the support shaft together with the housing, an inner race that surrounds the support shaft inside the outer race, and a rotatable element that is disposed between the outer race and the inner race, and the outboard motor further includes a fastener that fixes the bushing holder to the housing.

With the above structural arrangement, the bushing holder is fixed to the housing of the movable body by the fastener. The housing is supported by the support shaft of the steering actuator through the bearing. When the force that moves the front end of the steering arm upward or downward is transmitted to the housing through the bushing and the bushing holder, the housing turns around the centerline of the support shaft. Thus, the force is absorbed not only by the bushing turning relative to the bushing holder but also by the housing turning relative to the support shaft. It is thus possible to absorb a greater force.

The bushing is disposed behind the movable body.

With the above structural arrangement, the bushing is located behind the movable body and thus does not overlap the movable body in a side view of the outboard motor. With the conventional vessel propulsion apparatus described above, the pivot member is located in the piston member. Thus, as compared with the conventional vessel propulsion apparatus described above, the structure of the movable body is simplified. Furthermore, since the movable body is shortened in the right-left direction as compared with the conventional vessel propulsion apparatus described above, it is possible to enlarge the moving range of the movable body in the right-left direction, and to increase the steered angle of the outboard motor main body (the rotation angle around the centerline of the steering shaft).

The bushing may be disposed below the movable body, or may be disposed above the movable body.

The outboard motor further includes a clamp bracket attachable to a rear surface of a hull, and a swivel bracket rotatable around a tilt axis extending in the right-left direction with respect to the clamp bracket, the swivel bracket being rotatable together with the outboard motor main body and the movable body, and the movable body overlaps the tilt axis in a side view of the outboard motor.

With the above structural arrangement, when the outboard motor main body turns upward or downward around the tilt axis, the movable body also turns upward or downward around the tilt axis. In a case in which the movable body overlaps the tilt axis in a side view of the outboard motor, the volume of the space through which the movable body passes when the movable body turns around the tilt axis is smaller than in a case in which there is no overlap. Thus, it is possible to reduce the space in the hull in which a portion of the outboard motor main body is disposed when the outboard motor main body tilts up. This makes it possible to effectively utilize the space within the hull.

The outboard motor further includes a pair of clamp brackets each provided with an inner side surface, an inner circumferential surface that is open at the inner side surface, and an attachment attachable to a rear surface of a hull, and the pair of clamp brackets is spaced apart from each other in the right-left direction, and a swivel bracket disposed between the pair of clamp brackets and that is rotatable around a tilt axis extending in the right-left direction with respect to the pair of clamp brackets, and at least a portion of the movable body is surrounded by the inner circumferential surface of the clamp bracket in a side view of the outboard motor and the movable body is movable to a plurality of positions including a position above the swivel bracket and a position inside a space surrounded by the inner circumferential surface of the clamp bracket.

With the conventional vessel propulsion apparatus described above, since the steering cylinder is disposed between the transom bracket and the cowl of the outboard motor, it is necessary to ensure a space, in which the steering cylinder is disposed, between the transom bracket and the cowl of the outboard motor. With the above structural arrangement, the movable body is surrounded by the inner circumferential surface of the clamp bracket in a side view of the outboard motor. Thus, it is not necessary to provide the space, in which the movable body is disposed, between the clamp bracket and the cowl of the outboard motor main body. Furthermore, since the movable body moves into the inner circumferential surface of the clamp bracket, the clamp bracket need not to be disposed laterally of the moving range of the movable body. Thus, the pair of clamp brackets are prevented from increasing in size in the right-left direction.

When the outboard motor main body rotates in the right-left direction around the centerline of the steering shaft, the outboard motor main body approaches the right or left clamp bracket. If the width between the pair of clamp brackets in the right-left direction is large, the outboard motor main body may come into contact with the clamp bracket. Therefore, in order to prevent this, the clamp brackets need to be shortened in the front-rear direction or reduced in size in the right-left direction. With the above-described structural arrangement, the width between the pair of clamp brackets is reduced, so that the above measures are unnecessary.

The outboard motor further includes a support shaft extending in an axial direction parallel or substantially parallel to the tilt axis and that penetrates the clamp bracket in the axial direction, and the movable body is movable in the axial direction of the support shaft along the support shaft.

With the above structural arrangement, the movable body moves in the axial direction of the support shaft along the support shaft. If the support shaft is long, the moving range of the movable body is enlarged. If the moving range of the movable body is large, a steered angle of the outboard motor main body is increased. The support shaft is elongated so as to penetrate through the clamp bracket. Therefore, the moving range of the movable body is enlarged, and the steerable angle of the outboard motor main body is increased.

The swivel bracket includes a tubular portion surrounding the tilt axis and is inserted in the inner circumferential surface of the clamp bracket, and the movable body is movable to a position inside a space surrounded by both of the inner circumferential surface of the clamp bracket and the tubular portion of the swivel bracket.

With the above structural arrangement, the tubular portion corresponding to a tilt shaft is provided on the swivel bracket. The swivel bracket is rotatable around the tubular portion with respect to the clamp brackets. The movable body is movable to the inside of the tubular portion. In other words, the tilt shaft to be inserted in the clamp bracket defines a space inside which the movable body is disposed inside the clamp bracket. Accordingly, the width between the pair of clamp brackets is reduced while the moving range of the movable body is maintained.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

As described below, the outboard motor main body 2 is turnable rightward or leftward around a steering axis As, and is turnable upward or downward around a tilt axis At. The outboard motor main body 2 in a reference posture will be hereinafter described unless specific notice is given. The reference posture is a posture in which a rotation axis Ac of a crankshaft 7 extends in an up-down direction and a centerline Ap of a propeller shaft 10 extends in a front-rear direction. The front-rear direction, the up-down direction, and a right-left direction are defined based on the outboard motor main body 2 in the reference posture. A width direction corresponds to the right-left direction. "Lateral" and "laterally" mean "outward in the width direction."

Figure 1:
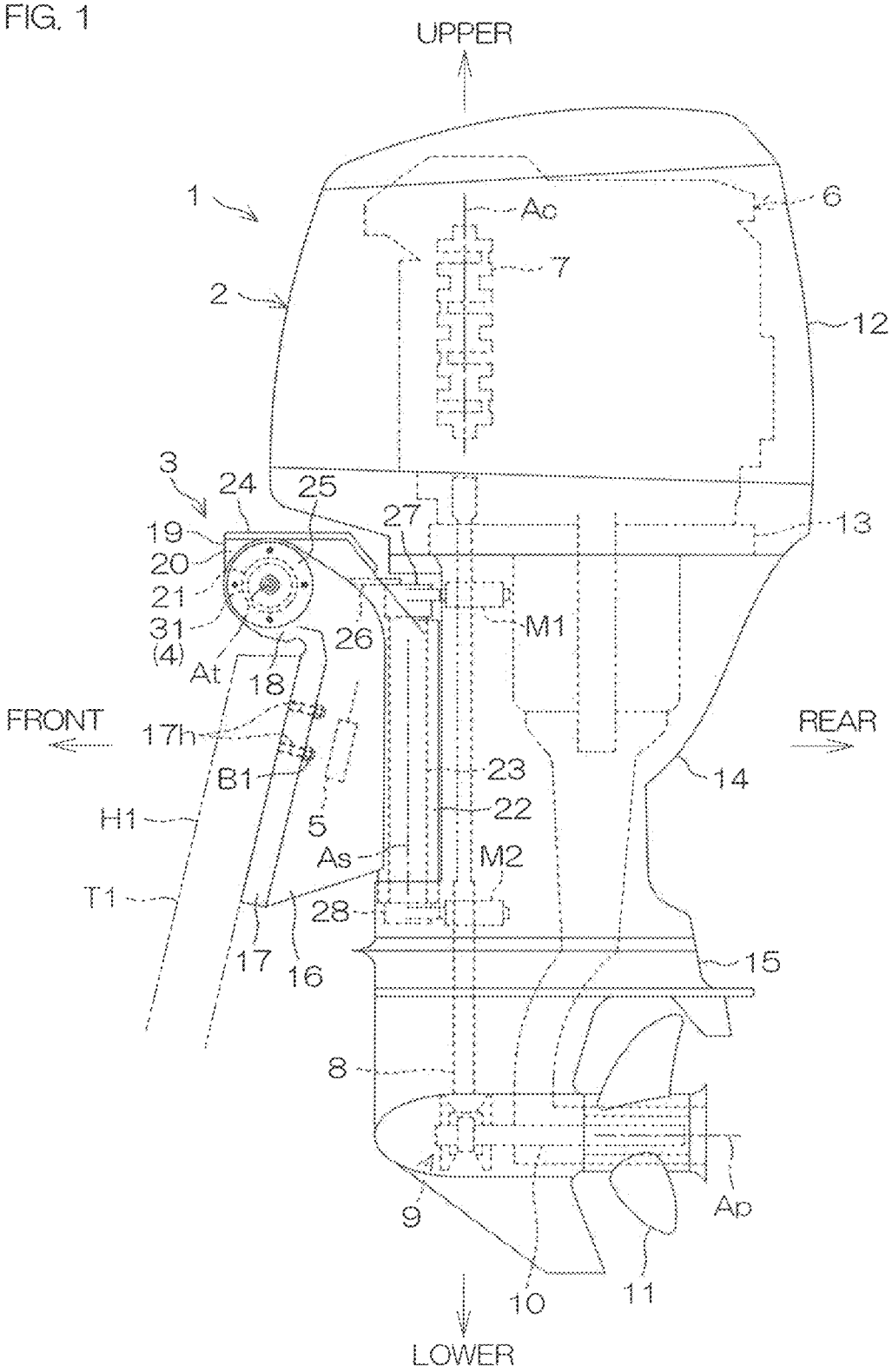
FIG. 1 is a schematic view showing the left side of an outboard motor according to a preferred embodiment of the present invention.
Figure 2:
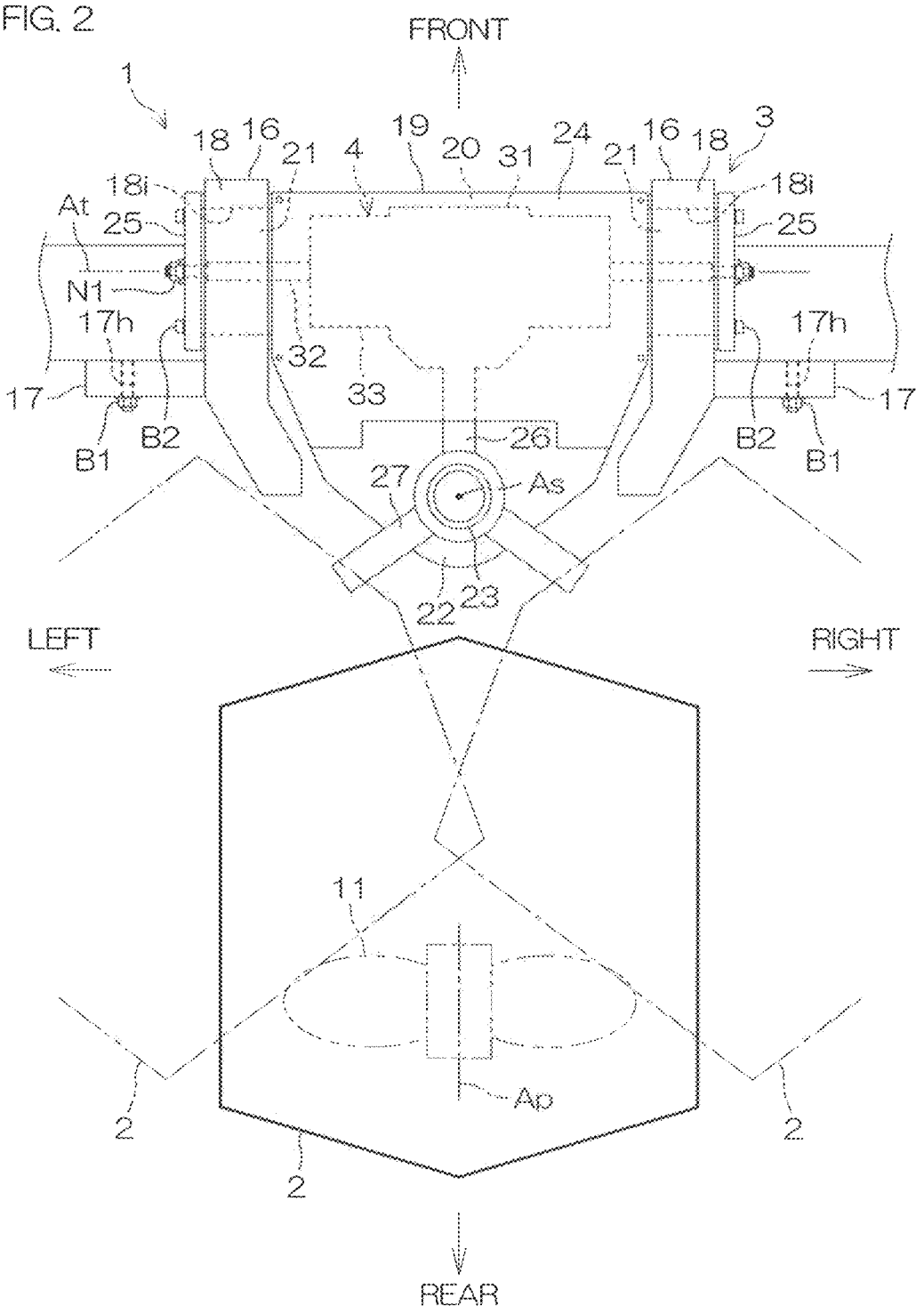
FIG. 2 is a schematic view showing a suspension device included in the outboard motor when viewed from above.

FIG. 1 is a schematic view showing the left side of an outboard motor 1 according to a preferred embodiment of the present invention. FIG. 2 is a schematic view of a suspension device 3 provided in the outboard motor 1 when viewed from above.

FIG. 2 shows the outline of the outer surface of an outboard motor main body 2 at the same height as the upper end of a transom T1 by bold lines, alternate long and short dashed lines, and chain double-dashed lines. The bold lines show the outboard motor main body 2 when located at an intermediate position between a right maximum steered position and a left maximum steered position. The alternate long and short dashed lines show the outboard motor main body 2 when located at the right maximum steered position, and the chain double-dashed lines show the outboard motor main body when located at the left maximum steered position.

As shown in FIG. 1, the outboard motor 1 includes the outboard motor main body 2 that generates thrust to propel the vessel, the suspension device 3 that attaches the outboard motor main body 2 to a hull H1, a steering device 4 that turns the outboard motor main body 2 rightward or leftward around a steering axis As extending in an up-down direction, and a tilt device 5 that turns the outboard motor main body 2 upward or downward around a tilt axis At extending in a right-left direction.

The outboard motor main body 2 includes an engine 6 as an example of a prime mover that generates power to rotate a propeller 11, and power transmissions 8 to 10 that transmit the power of the engine 6 to the propeller 11. The outboard motor main body 2 further includes an engine cowl 12 that houses the engine 6, and casings 13 to 15 that house the power transmissions 8 to 10. The casings 13 to 15 are disposed below the engine cowl 12.

The engine 6 includes a crankshaft 7 that is rotatable around a rotation axis Ac extending in the up-down direction. The casings include an exhaust guide 13 in which the engine 6 is located, an upper case 14 disposed under the exhaust guide 13, and a lower case 15 disposed under the upper case 14. The power transmissions include a drive shaft 8 extending in the up-down direction inside the upper case 14 and the lower case 15, a propeller shaft 10 extending in a front-rear direction inside the lower case 15, and a forward-reverse switching mechanism 9 to transmit the rotation from the drive shaft 8 to the propeller shaft 10. The propeller 11 is attached to the rear end portion of the propeller shaft 10 that projects rearward from the lower case 15.

The engine 6 rotates the crankshaft 7 in a certain rotational direction. The rotation of the crankshaft 7 is transmitted to the propeller 11 through the drive shaft 8, the forward-reverse switching mechanism 9, and the propeller shaft 10. This causes the propeller 11 to rotate around a centerline Ap of the propeller shaft 10 together with the propeller shaft 10, thus generating thrust to propel the hull H1 forward or rearward. The direction of the rotation transmitted from the drive shaft 8 to the propeller shaft 10 is switched by the forward-reverse switching mechanism 9. This allows the rotational direction of the propeller 11 to be switched over between the forward direction and the reverse direction that are opposite to each other.

As shown in FIG. 2, the suspension device 3 includes a pair of clamp brackets 16 attachable to a transom T1 provided on a rear portion of the hull H1, a swivel bracket 19 supported by the pair of clamp brackets 16 rotatably around the tilt axis At extending in the right-left direction, and a steering shaft 23 supported by the swivel bracket 19 rotatably around the steering axis As extending in the up-down direction.

The pair of clamp brackets 16 are respectively disposed on the right and left of the swivel bracket 19. The clamp bracket 16 includes an attachment 17 to be attached to the hull H1, and a swivel support 18 that supports the swivel bracket 19. The attachment 17 is disposed at the rear of the transom T1. The swivel support 18 is disposed above the transom T1. A bolt B1, for example, that fixes the clamp bracket 16 to the hull H1 is inserted in a through hole 17*h* that penetrates the attachment 17.

The swivel bracket 19 is disposed in front of the outboard motor main body 2. The swivel bracket 19 includes a housing 20 that houses the steering device 4, a pair of tubular portions 21 supported by the swivel supports 18 of the clamp brackets 16 and a tubular shaft support 22 that rotatably supports the steering shaft 23, and a pair of tubular portions 21 supported by the swivel supports 18 of the clamp brackets 16. The pair of tubular portions 22 are respectively disposed on the right and left of the housing 20. The tubular portions 21 project laterally from the housing 20. The shaft support 22 is disposed more rearward than the tubular portions 21. The steering shaft 23 is inserted in the shaft support 22. The centerline of the steering shaft 23 is located on the steering axis As.

The suspension device 3 includes a top cover 24 disposed over the swivel bracket 19, and a pair of end caps 25 disposed on the respective right and left of the pair of clamp brackets 16. The steering device 4 is disposed between the top cover 24 and the swivel bracket 19. Both end portions of the steering device 4 (both end portions of a steering rod 32 to be discussed later) are supported by the pair of respective end caps 25. The pair of end caps 25 are fixed to the pair of respective tubular portions 21 of the swivel bracket 19. Thus, the steering device 4 is supported by the swivel bracket 19 through the pair of end caps 25.

As shown in FIG. 1, the suspension device 3 includes a steering arm 26 that couples an upper end portion of the steering shaft 23 to the steering device 4, an upper mount bracket 27 that couples the upper end portion of the steering shaft 23 to the outboard motor main body 2 through an upper damper mount M1, and a lower mount bracket 28 that couples a lower end portion of the steering shaft 23 to the outboard motor main body 2 through a lower damper mount M2.

The steering arm 26 is disposed above the swivel bracket 19. The steering arm 26 extends forward from the steering shaft 23. The steering arm 26 rotates around the steering axis As together with the steering shaft 23. The front end portion of the steering arm 26 is disposed between the top cover 24 and the swivel bracket 19. The steering arm 26 and the upper mount bracket 27 preferably define an integral unitary structure. The steering arm 26 may be an independent structure from the upper mount bracket 27.

The upper mount bracket 27 and the lower mount bracket 28 are disposed above and below the swivel bracket 19, respectively. The upper mount bracket 27 is joined by a bolt to the upper damper mount M1, while the lower mount bracket 28 is joined by a bolt to the lower damper mount M2. The upper damper mount M1 and the lower damper mount M2 are retained in the outboard motor main body 2. The upper mount bracket 27 and the lower mount bracket 28 are rotated around the steering axis As together with the steering shaft 23.

Now, the suspension device 3 and the steering device 4 will be described below.

Figure 3:
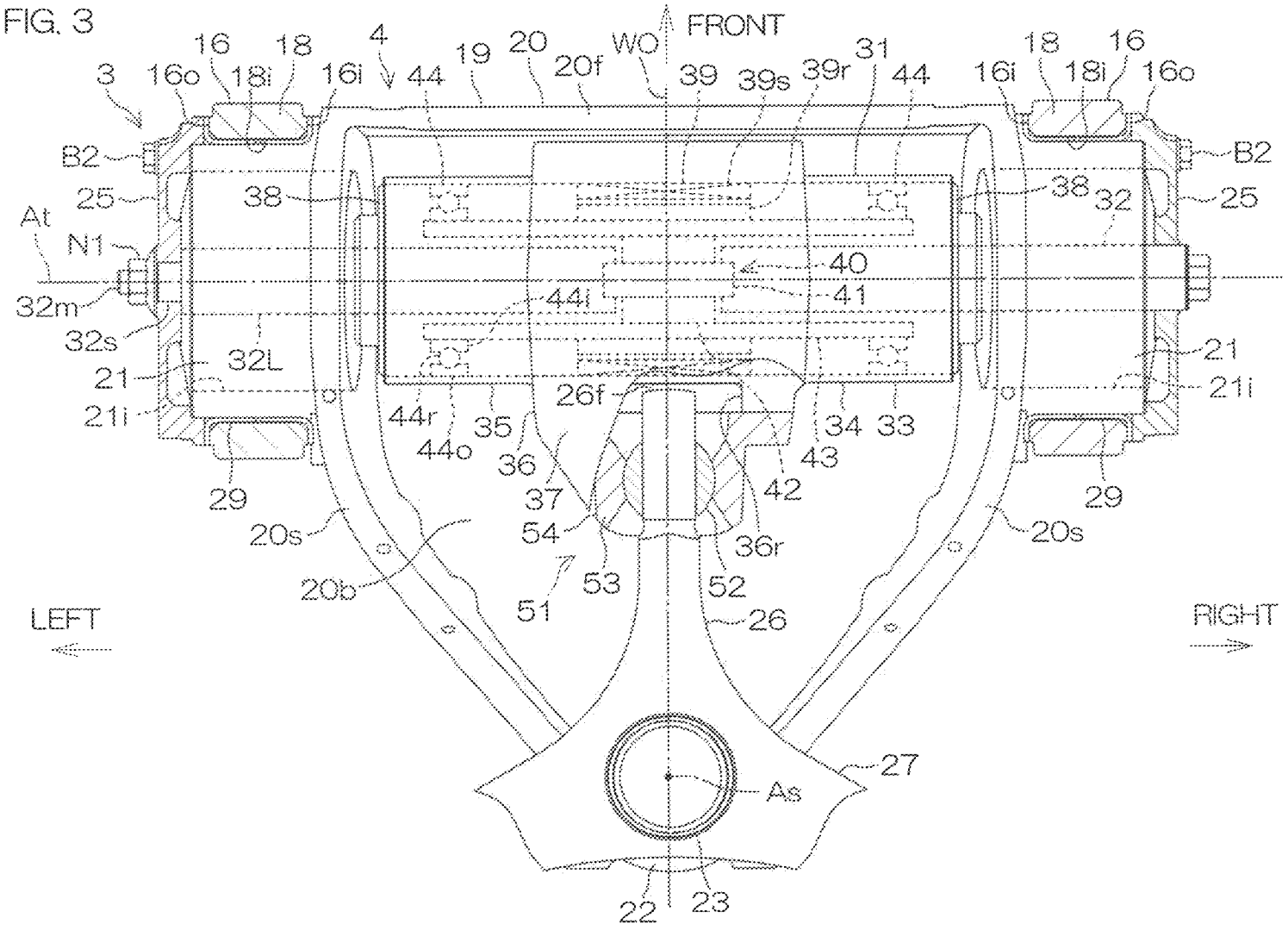
FIG. 3 is a partial cross-sectional view showing the suspension device and a steering device when viewed from above with a top cover removed.
Figure 4:
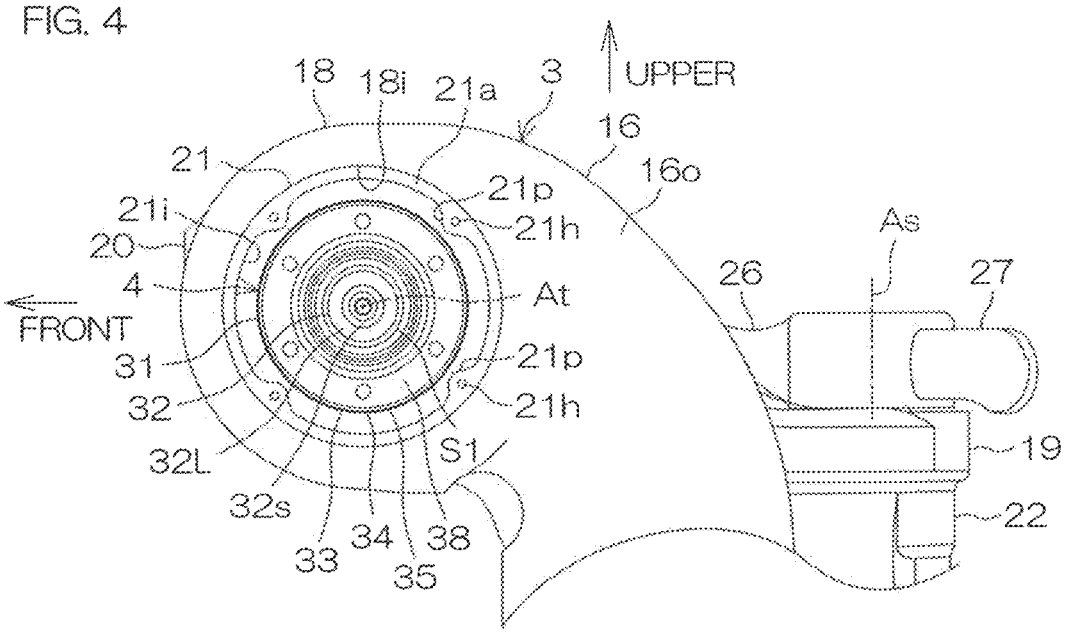
FIG. 4 is a side view showing an upper portion of the suspension device when viewed from the left side with an end cap removed.
Figure 5:
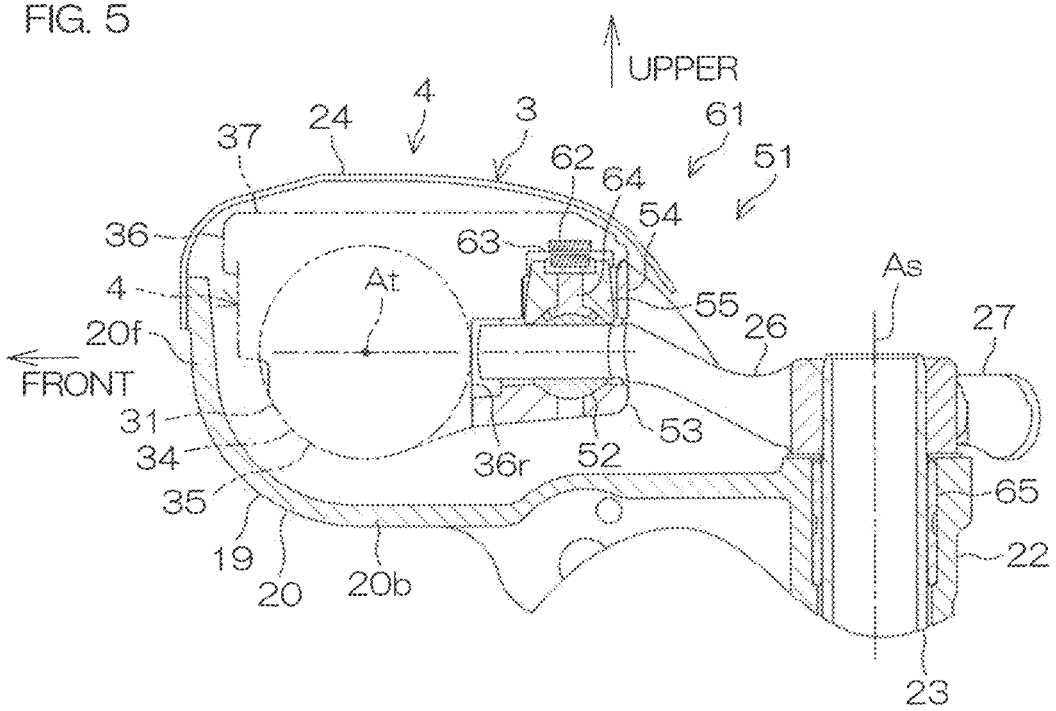
FIG. 5 is a partial cross-sectional view showing a cross section of the suspension device and the steering device cut along a reference plane.

FIG. 3 is a partial cross-sectional view showing the suspension device 3 and the steering device 4 when viewed from above with the top cover 24 removed. FIG. 4 is a side view showing the upper portion of the suspension device 3 when viewed from the left side with the end caps 25 removed. FIG. 5 is a partial cross-sectional view showing a cross section of the suspension device 3 and the steering device 4 cut along a reference plane WO. The reference plane WO corresponds to a vertical plane which passes through the steering axis As and is perpendicular or substantially perpendicular to the right-left direction.

As shown in FIG. 3, the housing 20 of the swivel bracket 19 includes a bottom wall 20*b* disposed between the pair of clamp brackets 16, a front wall 20*f* extending upward from a front edge of the bottom wall 20*b*, and two side walls 20*s* respectively extending upward from a right edge and a left edge of the bottom wall 20*b*. The top cover 24 (refer to FIG. 5) is joined to the housing 20 by bolts, for example. The top cover 24 and the housing 20 define a housing chamber that houses the steering device 4.

The pair of tubular portions 21 of the swivel bracket 19 project rightward or leftward from the sidewall 20*s* of the housing 20. The inner circumferential surface 21*i* of the tubular portion 21 is open on an inner side surface of the sidewall 20*s*. As shown in FIG. 4, the inner circumferential surface 21*i* of the tubular portion 21 is also open on an end surface of the tubular portion 21. The tubular portion 21 surrounds the tilt axis At in a side view. The tubular portion 21 includes an annular portion 21*a* that surrounds the tilt axis At in a side view, and a plurality of projections 21*p* that project inward from the inner circumferential surface of the annular portion 21*a*. The plurality of projections 21*p* are disposed at positions aligned with a plurality of female screw holes 21*h* that are open on the end surface of the tubular portion 21. A plurality of bolts B2, for example (see FIG. 3), that fix the end caps 25 to the swivel bracket 19, are bolted into the plurality of female screw holes 21*h*.

As shown in FIG. 3, the swivel support 18 of the clamp bracket 16 supports the tubular portion 21 of the swivel bracket 19 through a sleeve bushing 29 that is interposed between the tubular portion 21 and the swivel support 18. The swivel support 18 includes an inner circumferential surface 18*i* that surrounds the tubular portion 21. The inner circumferential surface 18*i* of the swivel support 18 is open on both an inner side surface 16*i* and an outer side surface 16*o* of the clamp bracket 16. The tubular portion 21 of the swivel bracket 19 penetrates the swivel support 18 in the right-left direction and projects laterally from the swivel support 18.

The end caps 25 are disposed laterally of the swivel support 18 of the clamp bracket 16 and the tubular portion 21 of the swivel bracket 19. The end caps 25 have an outer diameter that is greater than the inner diameter of the swivel support 18 (the diameter of the inner circumferential surface 18*i* of the swivel support 18). The opening provided on the end surface of the tubular portion 21 is closed by the end cap 25. The end caps 25 are fixed to the tubular portion 21 by the plurality of bolts B2.

The steering device 4 includes a steering actuator 31 to convert energy such as electric power or hydraulic pressure into linear motion in the right-left direction, and a motion converter 51 that converts the linear motion produced by the steering actuator 31 into a turning motion of the steering arm 26. The steering actuator 31 includes the steering rod 32 extending in the right-left direction, and a steering tube 33 that reciprocates in the right-left direction along the steering rod 32. The steering tube 33 is an example of a movable body that moves in the right-left direction, while the steering rod 32 is an example of a support shaft that supports the movable body.

FIG. 3 shows an example in which the steering actuator 31 is an electric actuator to convert electric power into linear motion of the steering tube 33 in the right-left direction, and reduction gears 40 included in the electric actuator include a roller screw assembly. The steering actuator 31 may be an actuator such as a hydraulic actuator other than the electric actuator. The reduction gears 40 may be a device such as a ball screw mechanism other than the roller screw assembly.

When the steering actuator 31 is an electric actuator, the steering tube 33 includes an inner tube 43 to surround the steering rod 32, and an electric motor 39 to rotate the inner tube 43. The steering tube 33 further includes the reduction gears 40 that relatively move the inner tube 43 and the steering rod 32 in the axial direction of the steering rod 32 as the inner tube 43 or the steering rod 32 is rotated, and a housing 34 that houses the inner tube 43, the electric motor 39, and the reduction gears 40. When the electric motor 39 rotates, the housing 34 moves in the right-left direction relative to the steering rod 32 together with the components accommodated in the housing 34 such as the electric motor 39 and the reduction gears 40.

The steering rod 32 supports the steering tube 33. The steering rod 32 penetrates the steering tube 33 in the right-left direction. The steering rod 32 further penetrates the swivel bracket 19 in the right-left direction. That is, the steering rod 32 passes through the spaces surrounded by the inner circumferential surfaces 21*i* of the two tubular portions 21 of the swivel bracket 19 and the space inside the housing 20 of the swivel bracket 19 in the right-left direction. Both end portions of the steering rod 32 project laterally from the two tubular portions 21 of the swivel bracket 19.

The steering rod 32 includes a large diameter portion 32L that penetrates the steering tube 33 in the right-left direction, a small diameter portion 32*s* that projects laterally from an end surface of the large diameter portion 32L, and a male screw portion 32*m* that projects laterally from an end surface of the small diameter portion 32*s*. The large diameter portion 32L, the small diameter portion 32*s*, and the male screw portion 32*m* are coaxial with each other. The outer diameter of the small diameter portion 32*s* is smaller than the outer diameter of the large diameter portion 32L, while the outer diameter of the male screw portion 32*m* is smaller than the outer diameter of the small diameter portion 32*s*. The large diameter portion 32L is longer in the right-left direction than any of the small diameter portion 32*s* and the male screw portion 32*m*. The large diameter portion 32L penetrates the swivel bracket 19 in the right-left direction.

Both end portions of the steering rod 32 are supported by the pair of respective end caps 25. The small diameter portion 32*s* of the steering rod 32 is inserted into a through hole that penetrates a central portion of the end cap 25 in the right-left direction. The male screw portions 32*m* of the steering rod 32 are disposed laterally of the end caps 25. The male screw portion 32*m* is screwed onto a fixing nut N1. The end cap 25 is sandwiched in the right-left direction between the inner side surface of the fixing nut N1 and the end surface of the large diameter portion 32L. This allows the end caps 25 to be fixed to the steering rod 32. Thus, the steering rod 32 is fixed to the swivel bracket 19 through the end caps 25.

The housing 34 includes a tubular main tube 35 that surrounds the steering rod 32, and a center box 36 that projects upward, forward, and rearward from a central portion of the main tube 35 in the right-left direction. The housing 34 further includes an upper cover 37 disposed above the center box 36, two ring-shaped end plates 38 disposed on both respective ends of the main tube 35, and two seal rings S1 that seal the space between the two end plates 38 and the steering rod 32 (see FIG. 4).

As shown in FIG. 4, the main tube 35 is surrounded in a side view by the inner circumferential surfaces 21*i* of the tubular portions 21 of the swivel bracket 19. The main tube 35 does not overlap any portion of the tubular portions 21 in a side view. The main tube 35 and the steering rod 32 each have a centerline located on the tilt axis At. The end plate 38 is surrounded by the main tube 35. The outer circumferential surface of the end plates 38 is in contact with the main tube 35, while the inner circumferential surface of the end plates 38 surrounds the steering rod 32. The two seal rings S1 are supported by the two respective end plates 38.

As shown in FIG. 3, the center box 36 is shorter than the main tube 35 in the right-left direction. The upper cover 37 is attached to an upper end portion of the center box 36. The upper end portion of the center box 36 defines an opening that is open upward. The opening of the center box 36 is covered with the upper cover 37. The rear surface of the center box 36 defines a recess 36*r* that is recessed forward. FIG. 3 shows the steering device 4 when the outboard motor main body 2 is disposed at the original position. When the outboard motor main body 2 is disposed at the original position, a front end 26*f* of the steering arm 26 is disposed inside the recess 36*r* of the center box 36.

The steering tube 33 is disposed in the housing 20 of the swivel bracket 19. The front wall 20*f* of the housing 20 is disposed in front of the steering tube 33, and the bottom wall 20*b* of the housing 20 is disposed below the steering tube 33. When the outboard motor main body 2 is disposed at the original position, the two sidewalls 20*s* of the housing 20 are disposed on the respective right and left of the main tube 35. As described below, when the steering actuator 31 moves the steering tube 33 in the right-left direction, the main tube 35 is brought into a space surrounded by both the swivel support 18 of the clamp bracket 16 and the tubular portion 21 of the swivel bracket 19.

The housing 34 accommodates the electric motor 39 and the reduction gears 40. The electric motor 39 includes a rotor 39*r* that surrounds the reduction gears 40, and a stator 39*s* that surrounds the rotor 39*r*. The reduction gears 40 include a center shaft 41 extending in the right-left direction, and a plurality of cylindrical rollers 42 that are disposed around the center shaft 41. The inner tube 43 surrounds the plurality of cylindrical rollers 42.

The center shaft 41 has a centerline located on the tilt axis At. The center shaft 41 may be integral with the steering rod 32 or may be a member which is separate from the steering rod 32 and fixed to the steering rod 32. A helical screw thread provided on the outer circumferential surface of each cylindrical roller 42 engages with a helical screw thread provided on the outer circumferential surface of the center shaft 41 and the spiral-shaped screw thread provided on the inner circumferential surface of the inner tube 43.

The rotation of the center shaft 41 is converted into a linear motion of the inner tube 43 through the center shaft 41, the cylindrical roller 42, and the inner tube 43. Likewise, the rotation of the inner tube 43 is converted into a linear motion of the center shaft 41 through the center shaft 41, the cylindrical roller 42, and the inner tube 43. When one of the center shaft 41 and the inner tube 43 is rotated, the other of the center shaft 41 and the inner tube 43 linearly moves, and thus the center shaft 41 and the inner tube 43 relatively move in the axial direction of the center shaft 41 (in the right-left direction).

The steering tube 33 includes a pair of bearings 44 interposed between the housing 34 and the inner tube 43. Each bearing 44 includes an inner race 44*i* surrounding the steering rod 32, an outer race 44*o* surrounding the inner race 44*i*, and a plurality of rotatable elements 44*r* disposed between the inner race 44*i* and the outer race 44*o*. The inner race 44*i* of the bearing 44 and the rotor 39*r* of the electric motor 39 rotate around the centerline of the steering rod 32 together with the inner tube 43. The outer race 44*o* of the bearing 44 and the stator 39*s* of the electric motor 39 rotate together with the housing 34.

When the electric motor 39 rotates the inner tube 43, the torque transmitted from the electric motor 39 to the inner tube 43 is converted into the drive power that linearly moves the inner tube 43 in the right-left direction through the center shaft 41, the cylindrical roller 42, and the inner tube 43. The drive power causes the steering tube 33 to move in the right or left direction relative to the steering rod 32. The amount of movement and the direction of movement of the steering tube 33 are controlled by the amount and the direction of rotation of the electric motor 39.

Now, the motion converter 51 and a steering angle detector 61 of the steering device 4 will be described below.

Figure 6:
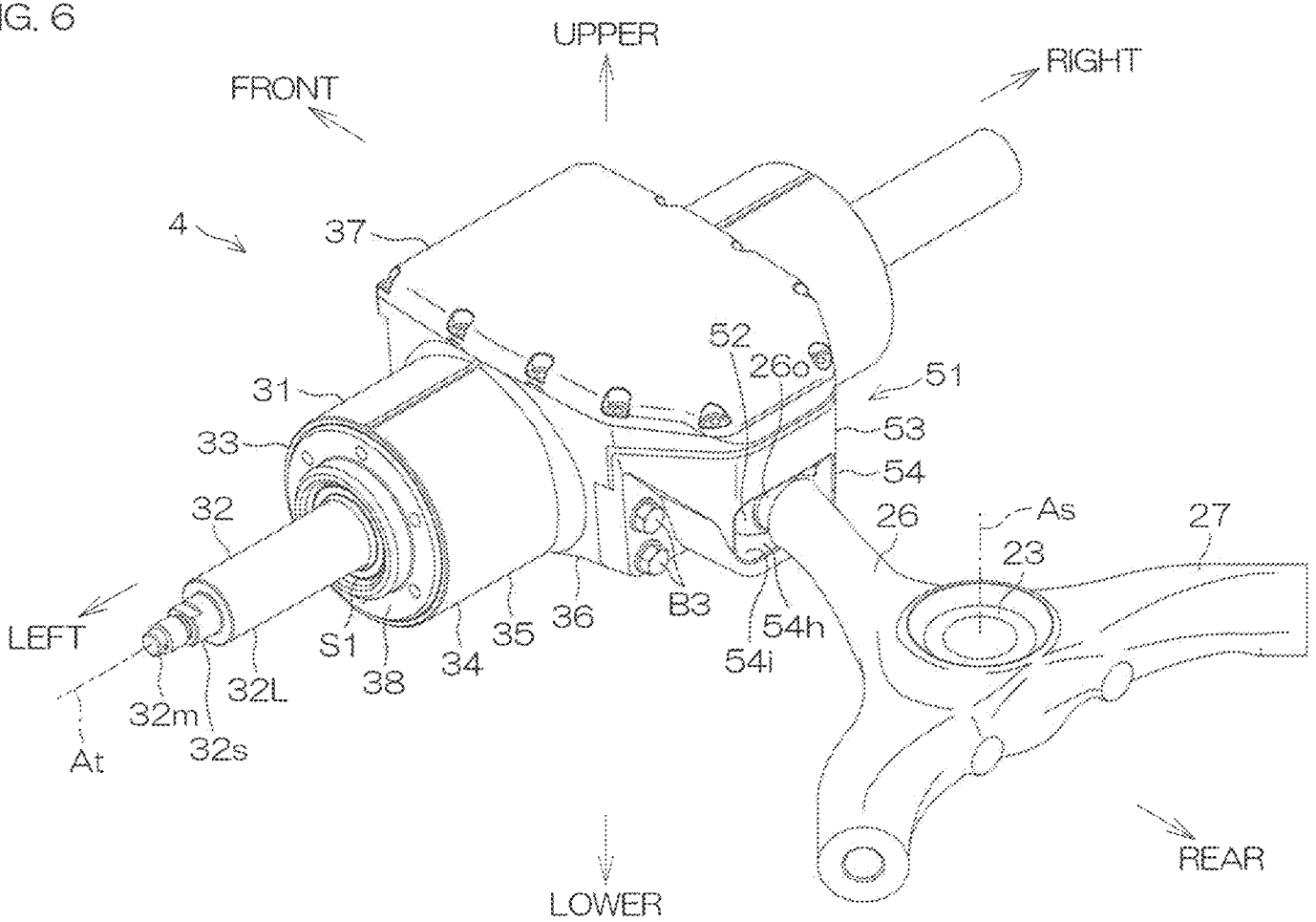
FIG. 6 is a rear left perspective view showing the steering device when viewed from diagonally above.
Figure 7:
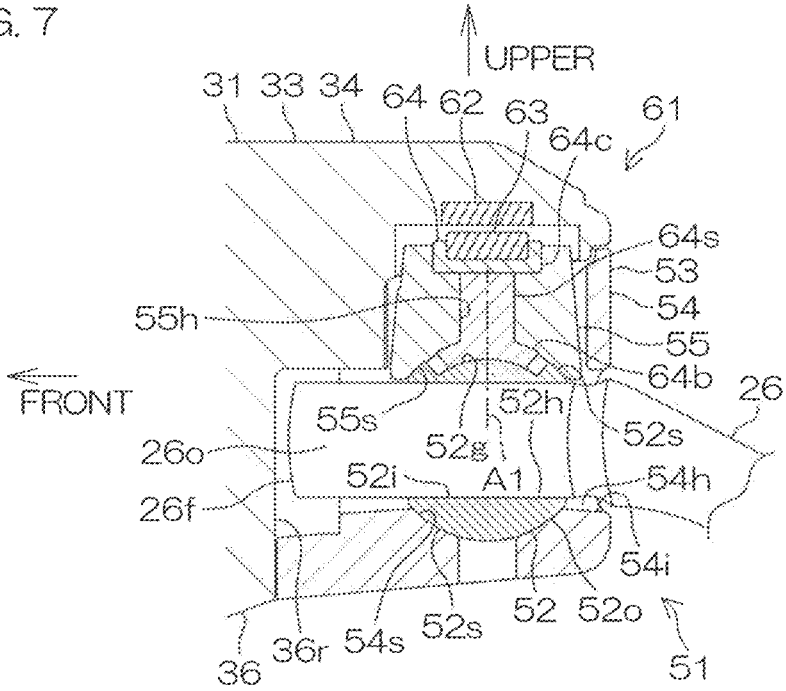
FIG. 7 is a cross-sectional view showing a vertical section of a motion converter in a direction perpendicular or substantially perpendicular to a right-left direction.
Figure 8:
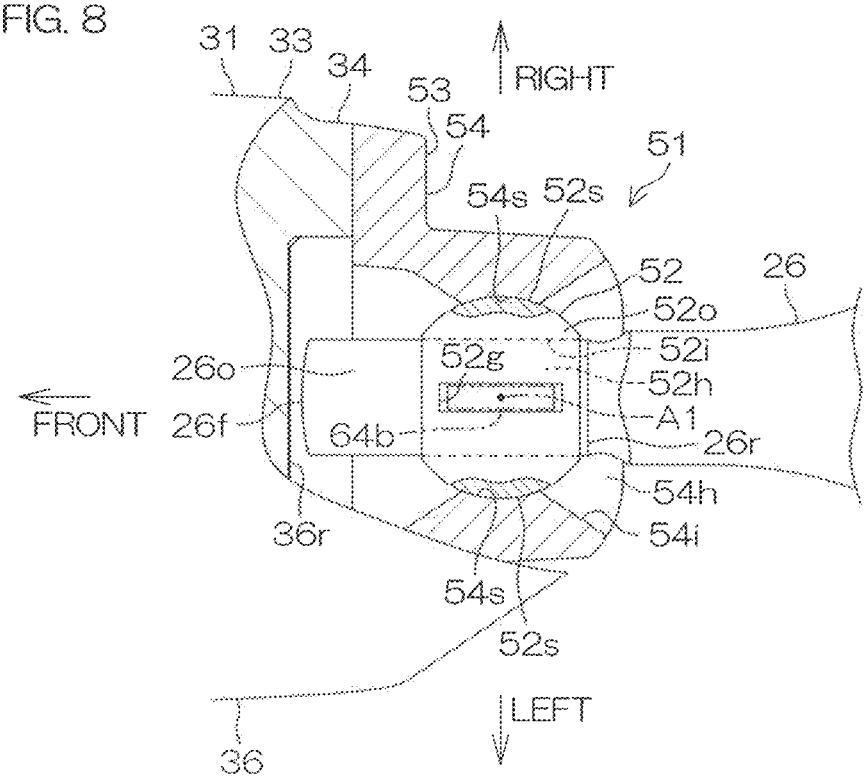
FIG. 8 is a cross-sectional view showing a horizontal section of the motion converter.

FIG. 6 is a rear left perspective view showing the steering device 4 when viewed from diagonally above. FIG. 7 is a cross-sectional view showing a vertical section of the motion converter 51 in a direction perpendicular or substantially perpendicular to the right-left direction. FIG. 8 is a cross-sectional view showing a horizontal section of the motion converter 51.

As shown in FIG. 6, the motion converter 51 includes a sphere-shaped bushing 52 attached to the front end portion of the steering arm 26, and a bushing holder 53 that holds the bushing 52. As shown in FIG. 7, the bushing holder 53 includes a main holder 54 into which the steering arm 26 is inserted, and an inner holder 55 that holds the bushing 52 together with the main holder 54.

The bushing 52, the main holder 54, and the inner holder 55 are disposed behind the center box 36 of the housing 34. The main holder 54 is fixed to the center box 36 by bolts B3, for example, which are an example of a fastener (see FIG. 6). The inner holder 55 is disposed inside the main holder 54. The inner holder 55 is fixed to the main holder 54 by bolts, for example. The main holder 54 and the inner holder 55 move in the right-left direction together with the steering tube 33 relative to the steering rod 32.

The main holder 54 includes a hemisphere-shaped lower support surface 54*s* disposed below the bushing 52. The inner holder 55 includes a hemisphere-shaped upper support surface 55*s* disposed above the bushing 52. Each of the upper support surface 55*s* and the lower support surface 54*s* has a radius of curvature that is equal or substantially equal to the radius of curvature of a sphere-shaped outer surface 52*o* of the bushing 52. The bushing 52 is sandwiched between the upper support surface 55*s* and the lower support surface 54*s* in the up-down direction. The bushing 52 is turnable relative to the bushing holder 53 around any axis that passes through the bushing 52.

The outer surface 52*o* of the bushing 52 includes a plurality of sliding portions 52*s* that are in contact with the upper support surface 55*s* and the lower support surface 54*s*. The center of the bushing 52 defines a midpoint of the bushing 52. As long as the sliding portion 52*s* is cut by a plane passing through the center of the bushing 52, a convex arc-shaped cross section appears when the sliding portion 52*s* is cut by any plane. For example, as shown in FIG. 7, when the sliding portion 52*s* is cut by a vertical plane that passes through the center of the bushing 52 and is perpendicular or substantially perpendicular to the right-left direction, an arc-shaped cross section convex in the upward or downward direction appears. As shown in FIG. 8, when the sliding portion 52*s* is cut by a horizontal plane that passes through the center of the bushing 52, an arc-shaped cross section convex in the right or left direction appears.

The front end portion of the steering arm 26 is inserted into an arm-insertion hole 54*h* that extends forward from the rear surface of the main holder 54. The bushing 52 is located in front of the arm-insertion hole 54*h*. The front end portion of the steering arm 26 is inserted into an insertion hole 52*h* extending forward from the outer surface 52*o* of the bushing 52. Thus, the front end portion of the steering arm 26 is inserted into both the arm-insertion hole 54*h* and the insertion hole 52*h*.

The arm-insertion hole 54*h* of the main holder 54 is open on the rear surface of the main holder 54. The arm-insertion hole 54*h* extends forward from the rear surface of the main holder 54 to the bushing 52. As shown in FIG. 8, the arm-insertion hole 54*h* has a width (a length in the right-left direction) that decreases toward the bushing 52. The width of the arm-insertion hole 54*h* on the rear surface of the main holder 54 is greater than the maximum outer diameter of the bushing 52. As shown in FIG. 7, the height (the length in the up-down direction) of the arm-insertion hole 54*h* on the rear surface of the main holder 54 is smaller than the maximum outer diameter of the bushing 52. The arm-insertion hole 54*h* may not have an entirely closed circumference but may be a notch.

The insertion hole 52*h* of the bushing 52 is defined by an inner circumferential surface 52*i* of the bushing 52. The inner circumferential surface 52*i* of the bushing 52 has a circular vertical section that is perpendicular or substantially perpendicular to the front-rear direction. The bushing 52 has an inner diameter (the diameter of the inner circumferential surface 52*i* of the bushing 52) that is constant from the front end of the insertion hole 52*h* to the rear end of the insertion hole 52*h*. As long as the insertion hole 52*h* has a uniform sectional shape from the front end of the insertion hole 52*h* to the rear end of the insertion hole 52*h*, the vertical section of the inner circumferential surface 52*i* of the bushing 52 may have any shape such as a polygonal shape other than a circular shape.

The inner circumferential surface 52*i* of the bushing 52 surrounds an outer circumferential surface 26*o* of the steering arm 26. The outer circumferential surface 26*o* of the steering arm 26 has the same sectional shape as that of the inner circumferential surface 52*i* of the bushing 52. FIG. 7 and FIG. 8 show an example in which the cross-sectional shape of the outer circumferential surface 26*o* of the steering arm 26 is circular. The outer diameter of the outer circumferential surface 26*o* of the steering arm 26 is constant from the front end of the outer circumferential surface 26*o* of the steering arm 26 (which corresponds to the front end 26*f* of the steering arm 26) to a rear end 26*r* of the outer circumferential surface 26*o* of the steering arm 26 (see FIG. 8). The bushing 52 is movable relative to the steering arm 26 along the outer circumferential surface 26*o* of the steering arm 26 in a direction perpendicular or substantially perpendicular to the steering axis As (see FIG. 6).

As shown in FIG. 7 and FIG. 8, the steering arm 26 is inserted into the insertion hole 52*h* from behind the bushing 52. The steering arm 26 penetrates the bushing 52 in the front-rear direction and projects forward from the bushing 52. The front end 26*f* of the steering arm 26 is located behind the center box 36 of the housing 34 and spaced apart from the center box 36.

As described below, when the outboard motor main body 2 is steered from the original position, the bushing 52 moves along the steering arm 26 toward the front end 26*f* of the steering arm 26. Even when the outboard motor main body 2 is located at the right maximum steered position or the left maximum steered position, the steering arm 26 penetrates the bushing 52, and the front end 26*f* of the steering arm 26 is located outside the bushing 52. Thus, the front end 26*f* of the steering arm 26 is located outside the bushing 52 when the outboard motor main body 2 is located at any position around the steering axis As.

As shown in FIG. 7, the steering device 4 includes the steering angle detector 61 that detects the steered angle of the outboard motor main body 2. FIG. 7 shows an example in which the steering angle detector 61 detects the rotation angle of the bushing 52. In the example, the steering angle detector 61 includes a magnet 63 that rotates together with the bushing 52, a steering angle sensor 62 that detects the rotation angle of the magnet 63, and a magnet holder 64 that holds the magnet 63 and transmits the rotation of the bushing 52 to the magnet 63. The steering angle detector 61 may detect the amount of movement of any movable portion such as the steering arm 26 other than the bushing 52.

The steering angle sensor 62 is disposed above the magnet 63. The steering angle sensor 62 is separated from the magnet 63. The steering angle sensor 62 is retained in the housing 34. The magnet 63 is movable relative to the steering angle sensor 62 around a turning axis A1 that is parallel or substantially parallel to the steering axis As and passes through the bushing 52. The magnet 63 is located above the magnet holder 64 and the inner holder 55.

The magnet holder 64 includes a cup 64*c* into which the magnet 63 is inserted, a base 64*b* in contact with the bushing 52, and a cylindrical shaft 64*s* extending from the base 64*b* to the cup 64*c*. The magnet 63 and the cup 64*c* are located above the inner holder 55. The base 64*b* is located below the inner holder 55. The shaft 64*s* is inserted into a through hole 55*h* extending upward from the upper support surface 55*s* of the inner holder 55. The magnet 63 and the magnet holder 64 are rotatable around the shaft 64*s* relative to the inner holder 55.

The base 64*b* of the magnet holder 64 is inserted into a fitting groove 52*g* that is recessed from the outer surface 52*o* of the bushing 52 toward the center of the bushing 52. As shown in FIG. 8, in a plan view, the fitting groove 52*g* of the bushing 52 has a strip shape extending in the front-rear direction. Likewise, the base 64*b* has a strip shape extending in the front-rear direction in a plan view. As shown in FIG. 7, the fitting groove 52*g* of the bushing 52 includes an arc-shaped bottom surface that is concentric with the outer surface 52*o* of the bushing 52. The base 64*b* includes an arc-shaped lower surface having a radius of curvature that is equal or substantially equal to that of the bottom surface of the fitting groove 52*g*. The base 64*b* is shorter than the fitting groove 52*g* in the front-rear direction. The base 64*b* is movable relative to the fitting groove 52*g* along the bottom surface of the fitting groove 52*g* in the front-rear direction.

When a force to turn the bushing 52 around the turning axis A1 is generated, the right and left side surfaces of the base 64*b* are pushed by the right and left side surfaces of the fitting groove 52*g*, so that the magnet holder 64 turns relative to the bushing holder 53 together with the bushing 52. This causes the steering angle sensor 62 and the magnet 63 to relatively move around the turning axis A1, thus detecting the rotation angle of the magnet 63. The steered angle of the outboard motor main body 2 is measured based on a value detected by the steering angle sensor 62.

Now, description will be made for the operation of the steering device 4 when the outboard motor main body 2 is steered.

Figure 9:
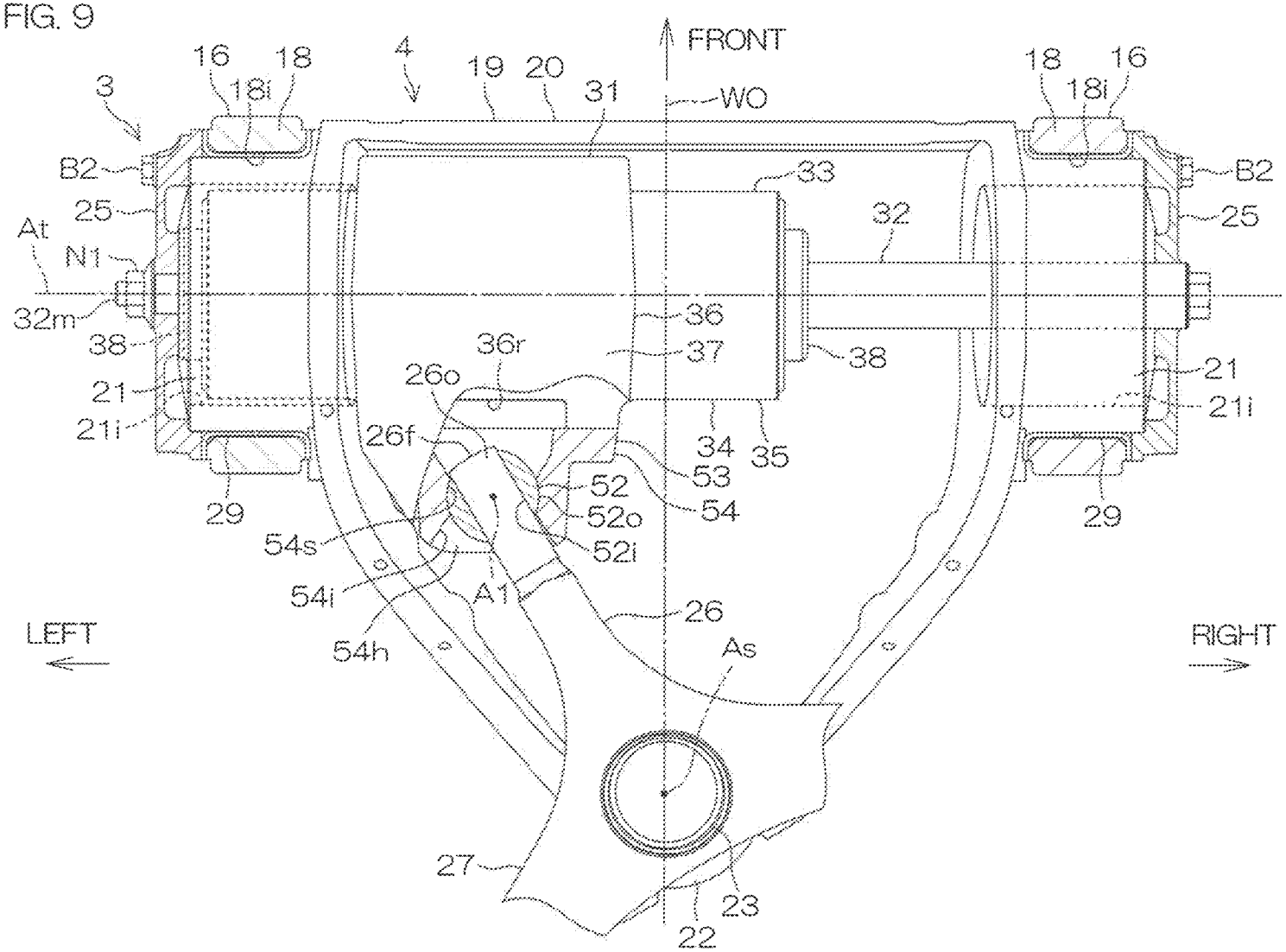
FIG. 9 is a partial cross-sectional view showing the suspension device when viewed from above with the top cover removed, illustrating a steering tube moved leftward.

FIG. 9 is a partially cross-sectional view of the suspension device 3 with the top cover 24 removed when viewed from above, showing the steering tube 33 moved to the left.

When the steering actuator 31 generates a right steering force to move the steering tube 33 in the left direction, the right steering force is transmitted to the steering arm 26 through the housing 34, the bushing holder 53, and the bushing 52. This causes the steering arm 26 to be pushed leftward, so that the steering arm 26 and the steering shaft 23 turn leftward around the steering axis As. This causes the outboard motor main body 2 to turn rightward around the steering axis As.

As understood by comparing FIG. 3 with FIG. 9, when the steering actuator 31 generates the right steering force, the steering arm 26 and the bushing 52 turn relative to the bushing holder 53 around the turning axis A1 that is parallel or substantially parallel to the steering axis As and that passes through the bushing 52 while the outer surface 52*o* of the bushing 52 slides on the bushing holder 53. Furthermore, the bushing 52 moves in a direction perpendicular or substantially perpendicular to the steering axis As along the outer circumferential surface 26*o* of the steering arm 26.

Likewise, when the steering actuator 31 generates a left steering force to move the steering tube 33 in the right direction, the left steering force is transmitted to the steering arm 26 through the housing 34, the bushing holder 53, and the bushing 52. This causes the steering arm 26 to be pushed rightward, so that the steering arm 26 and the steering shaft 23 turn rightward around the steering axis As. This also causes the outboard motor main body 2 to turn leftward around the steering axis As.

When the steering actuator 31 generates the left steering force, the steering arm 26 and the bushing 52 turn relative to the bushing holder 53 around the turning axis A1 that is parallel to the steering axis As and that passes through the bushing 52 while the outer surface 52*o* of the bushing 52 slides on the bushing holder 53. Furthermore, the bushing 52 moves along the outer circumferential surface 26*o* of the steering arm 26 in a direction perpendicular or substantially perpendicular to the steering axis As.

FIG. 9 shows the steering device 4 when the outboard motor main body 2 is located at the right maximum steered position. When the outboard motor main body 2 is located at the right maximum steered position, the left end portion of the steering tube 33 is located in a space surrounded by both the swivel support 18 of the left clamp bracket 16 and the left tubular portion 21 of the swivel bracket 19. At this time, the front end 26*f* of the steering arm 26 is located outside the bushing 52. Furthermore, the steering arm 26 is not in contact with but separated from the inner circumferential surface 54*i* of the arm-insertion hole 54*h* of the bushing holder 53.

Moving the steering tube 33 in the right direction will cause the outboard motor main body 2 to turn leftward around the steering axis As. The left maximum steered position and the right maximum steered position are symmetric to each other with respect to the reference plane WO. When the outboard motor main body 2 is located at the left maximum steered position, the right end portion of the steering tube 33 is located in a space that is surrounded by both the swivel support 18 of the right clamp bracket 16 and the right tubular portion 21 of the swivel bracket 19. At this time, the front end 26*f* of the steering arm 26 is located outside the bushing 52. Furthermore, the steering arm 26 is not in contact with but separated from the inner circumferential surface 54*i* of the arm-insertion hole 54*h* of the bushing holder 53.

Now, description will be made for the operation of the steering device 4 when a tilting force to tilt the outboard motor main body 2 forward or rearward is generated in accordance with the generation of the thrust.

Figure 10:
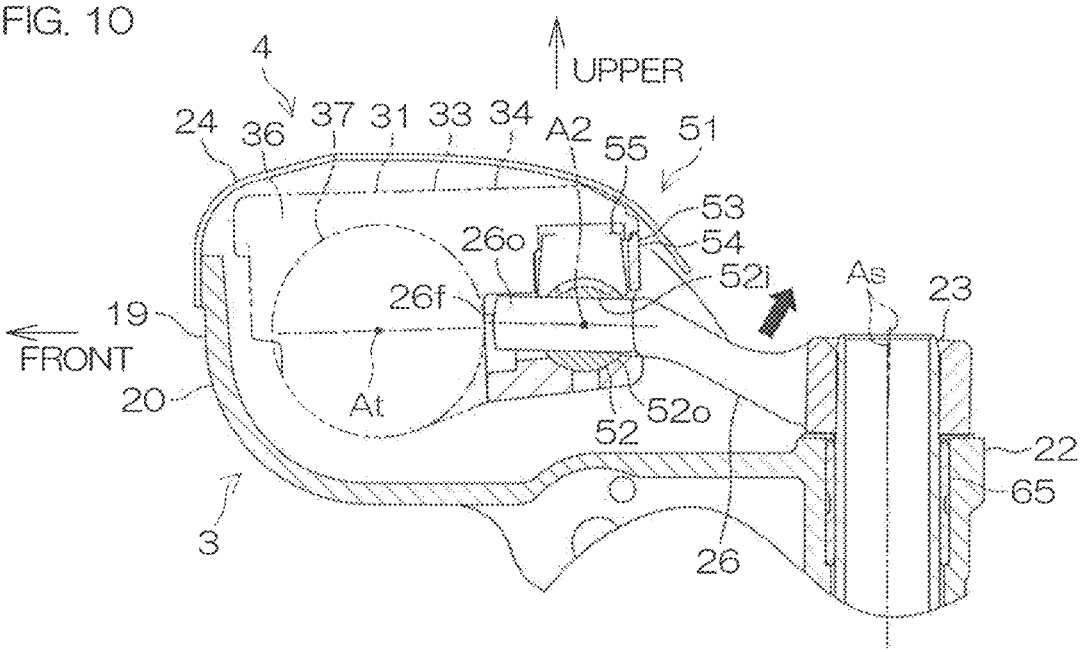
FIG. 10 is a partial cross-sectional view showing a cross section of the suspension device and the steering device taken along a reference plane, illustrating the steering device when the outboard motor main body propels the hull forward.
Figure 11:
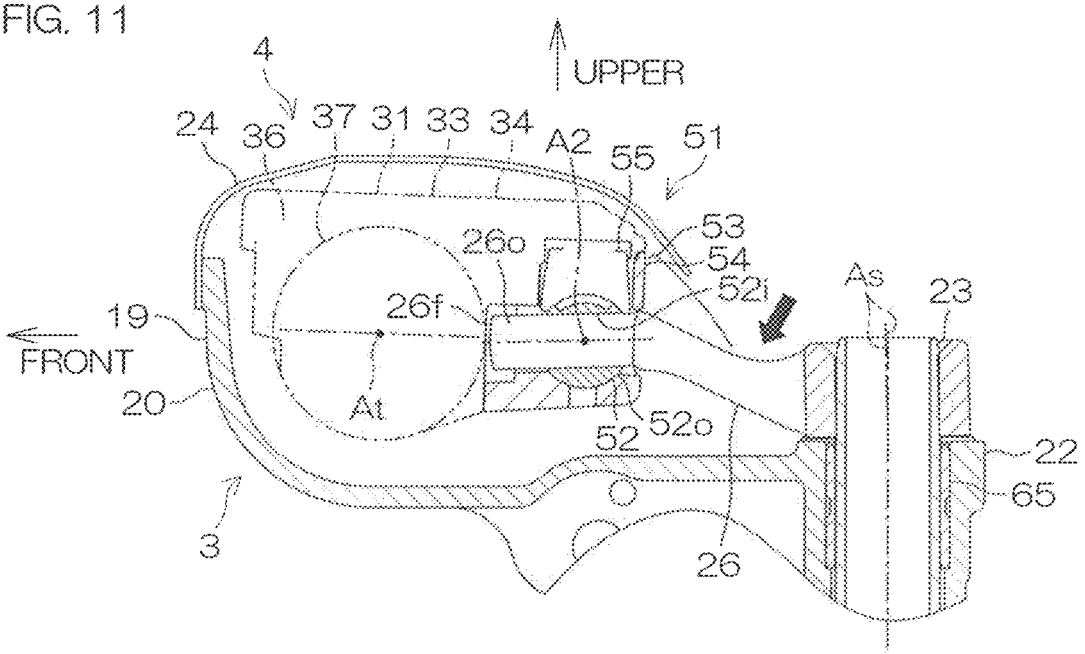
FIG. 11 is a partial cross-sectional view showing a cross section of the suspension device and the steering device taken along a reference plane, illustrating the steering device when the outboard motor main body propels the hull rearward.

FIG. 10 and FIG. 11 are partial cross-sectional views showing cross sections of the suspension device 3 and the steering device 4 taken along the reference plane WO. FIG. 10 shows the steering device 4 when the outboard motor main body 2 propels the hull H1 forward. FIG. 11 shows the steering device 4 when the outboard motor main body 2 propels the hull H1 rearward.

A high thrust to propel the hull H1 (see FIG. 1) forward will generate a tilting force that tilts the outboard motor main body 2 (see FIG. 1) rearward, that is, a force that causes the upper portion of the outboard motor main body 2 to move rearward relative to the hull H1 and the lower portion of the outboard motor main body 2 to move forward relative to the hull H1. In contrast, a high thrust to propel the hull H1 rearward will generate a tilting force that tilts the outboard motor main body 2 rearward, that is, a force that causes the upper portion of the outboard motor main body 2 to move forward relative to the hull H1 and the lower portion of the outboard motor main body 2 to move rearward relative to the hull H1.

The tilting force that tilts the outboard motor main body 2 forward or rearward is transmitted to the steering shaft 23 through the outboard motor main body 2. The steering shaft 23 is inserted into the shaft support 22 of the swivel bracket 19 and supported by the shaft support 22 through a sleeve bushing 65 surrounding the steering shaft 23. When the tilting force is transmitted to the steering shaft 23, the steering shaft 23 is tilted forward or rearward relative to the shaft support 22 within the range of a slight gap between the inner circumferential surface of the sleeve bushing 65 and the outer circumferential surface of the steering shaft 23. At this time, the front end 26*f* of the steering arm 26 moves slightly upward or downward relative to the swivel bracket 19.

As shown in FIG. 10, a high thrust to propel the hull H1 forward will generate a force to move the front end 26*f* of the steering arm 26 upward relative to the swivel bracket 19. This causes the steering arm 26 to push the bushing 52 upward and the bushing 52 to push the bushing holder 53 upward. At this time, while the outer surface 52*o* of the bushing 52 slides on the bushing holder 53, the steering arm 26 and the bushing 52 turn relative to the bushing holder 53 around a turning axis A2 that passes through the bushing 52 and that extends in the right-left direction.

Furthermore, the force to move the front end 26*f* of the steering arm 26 upward relative to the swivel bracket 19 is transmitted to the housing 34 through the bushing 52 and the bushing holder 53. Thus, the bushing holder 53 and the housing 34 turn upward around the tilt axis At. These operations cause the front end 26*f* of the steering arm 26 to move upward relative to the swivel bracket 19. Thus, the force of the steering arm 26 to push the bushing 52 upward is reduced, and the force of the bushing 52 to push the bushing holder 53 upward is reduced.

As shown in FIG. 11, a high thrust to propel the hull H1 rearward will generate a force to move the front end 26*f* of the steering arm 26 downward relative to the swivel bracket 19. This causes the steering arm 26 to push the bushing 52 downward and the bushing 52 to push the bushing holder 53 downward. At this time, while the outer surface 52*o* of the bushing 52 slides on the bushing holder 53, the steering arm 26 and the bushing 52 turn relative to the bushing holder 53 around the turning axis A2 that passes through the bushing 52 and that extends in the right-left direction.

Furthermore, the force to move the front end 26*f* of the steering arm 26 downward relative to the swivel bracket 19 is transmitted to the housing 34 through the bushing 52 and the bushing holder 53. Thus, the bushing holder 53 and the housing 34 turn downward around the tilt axis At. These operations cause the front end 26*f* of the steering arm 26 to move downward relative to the swivel bracket 19. Thus, the force of the steering arm 26 to push the bushing 52 downward is reduced, and the force of the bushing 52 to push the bushing holder 53 downward is reduced.

As described above, even when the outboard motor main body 2 generates a high thrust, and the steering shaft 23 tilts forward or rearward relative to the swivel bracket 19, the steering arm 26 is prevented from being pressed against the bushing 52 at high pressure, while the bushing 52 is prevented from being pressed against the bushing holder 53 at high pressure. Thus, when the outboard motor main body 2 is steered while the outboard motor main body 2 generates a high thrust, a high friction is not applied to the steering arm 26, the bushing 52, and the bushing holder 53. This enables the steering force to be efficiently transmitted from the steering device 4 to the outboard motor main body 2.

As described above, in the present preferred embodiment, the steering arm 26 extends forward from the steering shaft 23, and is inserted into the bushing holder 53 in the front-rear direction. The bushing 52 is interposed between the steering arm 26 and the bushing holder 53. The outer surface 52*o* of the bushing 52 includes the pair of sliding portions 52*s*. The bushing 52 is retained in the bushing holder 53 through at least the pair of sliding portions 52*s*. The sliding portion 52*s* includes a rotating body that is obtained by rotating an arc around a straight line that passes through the midpoint of the arc and the center of the arc.

When the engine 6 of the outboard motor main body 2 rotates the propeller 11, a thrust to propel the hull H1 forward or rearward is generated. When a force to move the front end 26*f* of the steering arm 26 upward or downward in a diagonally rearward direction is generated in accordance with the generation of the thrust, the bushing 52 turns relative to the bushing holder 53 around the turning axis A2 that passes through the bushing 52 and that extends in the right-left direction while the pair of sliding portions 52*s* of the outer surface 52*o* of the bushing 52 slide on the bushing holder 53.

Furthermore, the steering tube 33 of the steering actuator 31 moves in the right-left direction, whereas the steering arm 26 turns around the centerline of the steering shaft 23 extending in the up-down direction. Thus, moving the steering tube 33 in the right-left direction generates a force to turn the bushing 52 around the turning axis A1 that passes through the bushing 52 and that extends in the up-down direction. At this time, while the pair of sliding portions 52*s* of the outer surface 52*o* of the bushing 52 slide on the bushing holder 53, the bushing 52 turns around the vertical axis relative to the bushing holder 53.

As described above, when a force to move the front end 26*f* of the steering arm 26 upward or downward in a diagonally rearward direction is generated in accordance with the generation of the thrust, the bushing 52 turns relative to the bushing holder 53. Likewise, when the steering actuator 31 moves the steering tube 33 in the right-left direction, the bushing 52 turns relative to the bushing holder 53. That is, regardless of the direction of the torque applied to the bushing 52, the bushing 52 turns relative to the bushing holder 53 and the torque is released. This prevents the bushing 52 from being pressed against the bushing holder 53 at high pressure, thus efficiently transmitting the power of the steering actuator 31 to the outboard motor main body 2.

In the present preferred embodiment, when the outboard motor main body 2 is steered, the bushing 52 moves along the steering arm 26 in a direction perpendicular or substantially perpendicular to the centerline of the steering shaft 23. When the outboard motor main body 2 is located at the right maximum steered position or the left maximum steered position, the bushing 52 is the farthest from the centerline of the steering shaft 23, so that the distance from the centerline of the steering shaft 23 to the bushing 52 is the longest. As the outboard motor main body 2 approaches an original position at the midpoint between the right maximum steered position and the left maximum steered position, the bushing 52 comes closer to the centerline of the steering shaft 23.

The front end 26*f* of the steering arm 26 is located in front of the bushing 52 when the outboard motor main body 2 is located at either of the right maximum steered position or the left maximum steered position. Thus, when the outboard motor main body 2 is located at any position within the range from the right maximum steered position to the left maximum steered position, the steering arm 26 projects forward from the bushing 52, and the front end 26*f* of the steering arm 26 is located in front of the bushing 52.

In a case in which the front end 26*f* of the steering arm 26 is located inside the bushing 52, when the outboard motor main body 2 is steered, the bushing 52 moves along the steering arm 26, and the length of a portion of the steering arm 26 in contact with the bushing 52 varies. Thus, locating the front end 26*f* of the steering arm 26 in front of the bushing 52 at all times makes it possible to stabilize the contact area between the steering arm 26 and the bushing 52 and minimize variations in pressure caused between the steering arm 26 and the bushing 52.

In the present preferred embodiment, the steering arm 26 is inserted into the arm-insertion hole 54*h* of the bushing holder 53. When the steering actuator 31 moves the steering tube 33 in the right-left direction, the angle of the steering arm 26 with respect to the arm-insertion hole 54*h* changes. The width of the arm-insertion hole 54*h*, that is, the length of the arm-insertion hole 54*h* in the right-left direction increases at the rear end of the arm-insertion hole 54*h*. Thus, when the steering tube 33 moves in the right-left direction, it is possible to prevent the steering arm 26 from coming into contact with the bushing holder 53.

In the present preferred embodiment, the bushing holder 53 is fixed to the housing 34 of the steering tube 33 using the bolts B3, which are an example of a fastener. The housing 34 is supported by the steering rod 32 of the steering actuator 31 through the bearings 44. When the force to move the front end 26*f* of the steering arm 26 upward or downward is transmitted to the housing 34 through the bushing 52 and the bushing holder 53, the housing 34 turns around the centerline of the steering rod 32. Thus, the force is absorbed not only by the bushing 52 turning relative to the bushing holder 53 but also by the housing 34 turning relative to the steering rod 32. It is thus possible to absorb a greater force.

In the present preferred embodiment, the bushing 52 is located behind the steering tube 33 and thus does not overlap the steering tube 33 in a side view. With the conventional vessel propulsion apparatus described above, the pivot member is located in the piston member. Thus, as compared with the conventional vessel propulsion apparatus described above, the structure of the steering tube 33 is simplified. Furthermore, since the steering tube 33 is shortened in the right-left direction as compared with the conventional vessel propulsion apparatus described above, the moving range of the steering tube 33 is enlarged in the right-left direction, and the steered angle of the outboard motor main body 2 (the rotation angle around the centerline of the steering shaft 23) is also increased.

In the present preferred embodiment, when the outboard motor main body 2 rotates upward or downward around the tilt axis At, the steering tube 33 also rotates upward or downward around the tilt axis At. In a case in which the steering tube 33 overlaps the tilt axis At in a side view, the volume of the space through which the steering tube 33 passes when the steering tube 33 rotates around the tilt axis At is smaller as compared with a case in which the steering tube 33 does not overlap the tilt axis. Therefore, a space inside the hull H1 in which a portion of the outboard motor main body 2 is disposed when the outboard motor main body 2 is tilted up is reduced. Accordingly, the space inside the hull H1 is effectively utilized.

In U.S. Pat. No. 7,311,571 B1 described above, since the steering cylinder is disposed between the transom bracket and the cowl of the outboard motor, it is necessary to ensure a space, in which the steering cylinder is disposed, between the transom bracket and the cowl of the outboard motor. In the present preferred embodiment, the steering tube 33 is surrounded in a side view by the inner circumferential surface 18*i* of the swivel support 18 of the clamp bracket 16. Thus, it is not necessary to provide the space, in which the steering tube 33 is disposed, between the clamp bracket 16 and the engine cowl 12 of the outboard motor main body 2. Furthermore, since the steering tube 33 moves into the inner circumferential surface 18*i* of the swivel support 18 of the clamp bracket 16, the clamp bracket 16 need not be disposed laterally of the moving range of the steering tube 33. Thus, the pair of clamp brackets 16 are prevented from increasing in size in the right-left direction.

When the outboard motor main body 2 rotates in the right-left direction around the centerline of the steering shaft 23, the outboard motor main body 2 approaches the right or left clamp bracket 16. If the width between the pair of clamp brackets 16 in the right-left direction is large, the outboard motor main body 2 may come into contact with the clamp bracket 16. Thus, in order to prevent this, the clamp brackets 16 need to be shortened in the front-rear direction or reduced in size in the right-left direction. In the present preferred embodiment, since the width between of the pair of clamp brackets 16 is reduced, it is not necessary to take such measures.

In the present preferred embodiment, the steering tube 33 moves in the axial direction of the steering rod 32 along the steering rod 32. If the steering rod 32 is long, the range in which the steering tube 33 is movable is enlarged. If the range in which the steering tube 33 is movable is large, the steered angle of the outboard motor main body 2 is increased. The steering rod 32 is elongated so as to penetrate through the clamp brackets 16. Therefore, the range in which the steering tube 33 is movable is enlarged, and the steered angle of the outboard motor main body 2 is increased.

In the present preferred embodiment, the tubular portion 21 corresponding to a tilt shaft is provided on the swivel bracket 19. The swivel bracket 19 is rotatable around the tubular portion 21 with respect to the clamp bracket 16. The steering tube 33 is movable to the inside of the tubular portion 21. In other words, a tilt shaft to be inserted in the clamp bracket 16 defines, inside the clamp bracket 16, a space in which the steering tube 33 is disposed. Accordingly, while a moving range of the steering tube 33 is maintained, the width between the pair of clamp brackets 16 is reduced.

Other Preferred Embodiments

The present invention is not restricted to the contents of the preferred embodiments described above, and various modifications are possible.

For example, instead of the ball bushing 52, the motion converter 51 of the steering device 4 may include a cylindrical bushing extending in the up-down direction and a cylindrical bushing extending in the right-left direction. In this case, the cylindrical bushing extending in the right-left direction is retained in the bushing holder 53, and disposed between the bushing holder 53 and the steering arm 26.

When the outboard motor main body 2 is located at the right maximum steered position or the left maximum steered position, the front end 26*f* of the steering arm 26 may be located within the insertion hole 52*h* of the bushing 52. In this case, the front end 26*f* of the steering arm 26 may be located in front of the center of the bushing 52 (the point through which the turning axis A1 passes in FIG. 8) which defines a midpoint of the bushing 52, or may be located behind the center of the bushing 52.

The bushing 52 may be disposed not behind the steering tube 33 but below or above the steering tube 33.

The width of the arm-insertion hole 54*h* of the main holder 54 may be constant from the front end of the arm-insertion hole 54*h* to the rear end of the arm-insertion hole 54*h*.

The housing 34 of the steering device 4 may be non-rotatable around the centerline of the steering rod 32 relative to the steering rod 32.

Even if the housing 34 does not rotate relative to the steering rod 32, when a force to move the front end 26*f* of the steering arm 26 upward or downward in a diagonally rearward direction is generated, the bushing 52 turns relative to the bushing holder 53 around the turning axis A2 that passes through the bushing 52 and that extends in the right-left direction while the bushing 52 slides on the bushing holder 53. Thus, the bushing 52 is prevented from being pressed against the bushing holder 53 at high pressure.

The centerline of the steering tube 33 and the steering rod 32 need not to be located on the tilt axis At. In this case, the steering tube 33 and the steering rod 32 may or may not overlap the tilt axis At in a side view.

The steering tube 33 may reciprocate in the right-left direction within the housing 20 of the swivel bracket 19 without entering into the tubular portion 21 of the swivel bracket 19.

The steering actuator 31 may be disposed outside the housing 20 of the swivel bracket 19. In this case, the steering rod 32 may not penetrate the clamp bracket 16 in the right-left direction.

The tubular portion 21 that is inserted into the inner circumferential surface 18*i* of the swivel support 18 of the clamp bracket 16 may be a member that is separate from the housing 20 of the swivel bracket 19. In this case, the tubular portion 21 may be fixed to the swivel bracket 19 by press fitting, welding, or bolting, or by any method other than these.

Features of two or more of the various preferred embodiments described above may be combined.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

a steering shaft extending in an up-down direction;

an outboard motor main body that rotates around a centerline of the steering shaft together with the steering shaft and that includes a prime mover that generates power to rotate a propeller;

a steering arm that extends forward from the steering shaft and that turns around the centerline of the steering shaft together with the steering shaft;

a steering actuator including a movable body that moves in a right-left direction; and a motion converter that converts a movement of the movable body in the right-left direction into a turning motion of the steering arm around the centerline of the steering shaft, and that includes a bushing holder in which the steering arm extends in a front-rear direction and a bushing interposed between the steering arm and the bushing holder and including an outer surface provided with a pair of first sliding portions each including a convex arc-shaped vertical section that is perpendicular or substantially perpendicular to the right-left direction.

2. The outboard motor according to claim 1, wherein the outer surface of the bushing further includes a pair of second sliding portions each including a convex arc-shaped horizontal section that is perpendicular or substantially perpendicular to the up-down direction.

3. The outboard motor according to claim 2, wherein the outboard motor main body is turnable around the centerline of the steering shaft between a right maximum steered position in which the outboard motor main body is steered to a rightmost position and a left maximum steered position in which the outboard motor main body is steered to a leftmost position; and a front end of the steering arm extends farther forward than a midpoint of the bushing in the front-rear direction when the outboard motor main body is at either of the right maximum steered position and the left maximum steered position.

4. The outboard motor according to claim 2, wherein the bushing holder includes an inner circumferential surface defining an arm-insertion hole in which the steering arm is located; and a length of the arm-insertion hole in the right-left direction increases at a rear end of the arm-insertion hole.

5. The outboard motor according to claim 2, wherein the steering actuator further includes a support shaft that penetrates the movable body in the right-left direction;

the movable body includes a bearing surrounding the support shaft and a housing surrounding the bearing;

the bearing includes an outer race that rotates around a centerline of the support shaft together with the housing, an inner race that surrounds the support shaft inside the outer race and a rotatable element disposed between the outer race and the inner race; and the outboard motor further comprises a fastener that fixes the bushing holder to the housing.

6. The outboard motor according to claim 1, wherein the bushing is disposed behind the movable body.

7. The outboard motor according to claim 1, wherein the bushing is disposed below the movable body.

8. The outboard motor according to claim 1, wherein the bushing is disposed above the movable body.

9. The outboard motor according to claim 1, further comprising:

a clamp bracket attachable to a rear surface of a hull; and a swivel bracket rotatable around a tilt axis extending in the right-left direction with respect to the clamp bracket, the swivel bracket being rotatable together with the outboard motor main body and the movable body; wherein the movable body overlaps the tilt axis in a side view of the outboard motor.

10. The outboard motor according to claim 1, further comprising:

a pair of clamp brackets each provided with an inner side surface, an inner circumferential surface that is open at the inner side surface, and an attachment attachable to a rear surface of a hull, the pair of clamp brackets being spaced apart from each other in the right-left direction; and a swivel bracket disposed between the pair of clamp brackets, and rotatable around a tilt axis extending in the right-left direction with respect to the pair of clamp brackets; wherein at least a portion of the movable body is surrounded by the inner circumferential surface of the clamp bracket in a side view of the outboard motor, and the movable body is movable to a plurality of positions including a position above the swivel bracket and a position inside a space surrounded by the inner circumferential surface of the clamp bracket.

11. An outboard motor comprising:

a steering shaft extending in an up-down direction;

an outboard motor main body that rotates around a centerline of the steering shaft together with the steering shaft and that includes a prime mover that generates power to rotate a propeller;

a steering arm that extends forward from the steering shaft and that turns around the centerline of the steering shaft together with the steering shaft;

a steering actuator including a movable body that moves in a right-left direction; and a motion converter that converts a movement of the movable body in the right-left direction into a turning motion of the steering arm around the centerline of the steering shaft, and that includes a bushing holder in which the steering arm extends in a front-rear direction and a bushing interposed between the steering arm and the bushing holder and including an outer surface provided with a pair of sliding portions each having a spherical shape.

12. The outboard motor according to claim 11, wherein the outboard motor main body is turnable around the centerline of the steering shaft between a right maximum steered position in which the outboard motor main body is steered to a rightmost position and a left maximum steered position in which the outboard motor main body is steered to a leftmost position; and a front end of the steering arm extends farther forward than a midpoint of the bushing in the front-rear direction when the outboard motor main body is at either of the right maximum steered position and the left maximum steered position.

13. The outboard motor according to claim 11, wherein the bushing holder includes an inner circumferential surface defining an arm-insertion hole in which the steering arm is located; and a length of the arm-insertion hole in the right-left direction increases at a rear end of the arm-insertion hole.

14. The outboard motor according to claim 11, wherein the steering actuator further includes a support shaft that penetrates the movable body in the right-left direction;

the movable body includes a bearing surrounding the support shaft and a housing surrounding the bearing;

the bearing includes an outer race that rotates around a centerline of the support shaft together with the housing, an inner race that surrounds the support shaft inside the outer race, and a rotatable element disposed between the outer race and the inner race; and the outboard motor further comprises a fastener that fixes the bushing holder to the housing.

15. The outboard motor according to claim 11, wherein the bushing is disposed behind the movable body.

16. The outboard motor according to claim 11, wherein the bushing is disposed below the movable body.

17. The outboard motor according to claim 11, wherein the bushing is disposed above the movable body.

18. The outboard motor according to claim 11, further comprising:

a clamp bracket attachable to a rear surface of a hull; and a swivel bracket rotatable around a tilt axis extending in the right-left direction with respect to the clamp bracket, the swivel bracket being rotatable together with the outboard motor main body and the movable body; wherein the movable body overlaps the tilt axis in a side view of the outboard motor.

19. The outboard motor according to claim 11, further comprising:

a pair of clamp brackets each provided with an inner side surface, an inner circumferential surface that is open at the inner side surface, and an attachment attachable to a rear surface of a hull, the pair of clamp brackets being spaced apart from each other in the right-left direction; and a swivel bracket disposed between the pair of clamp brackets, and rotatable around a tilt axis extending in the right-left direction with respect to the pair of clamp brackets; wherein at least a portion of the movable body is surrounded by the inner circumferential surface of the clamp bracket in a side view of the outboard motor, and the movable body is movable to a plurality of positions including a position above the swivel bracket and a position inside a space surrounded by the inner circumferential surface of the clamp bracket.

20. The outboard motor according to claim 19, further comprising:

a support shaft extending in an axial direction parallel or substantially parallel to the tilt axis and that penetrates the clamp bracket in the axial direction; wherein the movable body is movable in the axial direction of the support shaft along the support shaft.

21. The outboard motor according to claim 19, wherein the swivel bracket includes a tubular portion surrounding the tilt axis and is located in the inner circumferential surface of the clamp bracket; and the movable body is movable to a position inside a space surrounded by both of the inner circumferential surface of the clamp bracket and the tubular portion of the swivel bracket.

* * * * *